US007168408B2

(12) United States Patent
Toda

(10) Patent No.: US 7,168,408 B2
(45) Date of Patent: Jan. 30, 2007

(54) CONTROL DEVICE OF INTERNAL COMBUSTION ENGINE

(75) Inventor: Tadashi Toda, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/389,106

(22) Filed: Mar. 27, 2006

(65) Prior Publication Data

US 2006/0219207 A1 Oct. 5, 2006

(30) Foreign Application Priority Data

Apr. 1, 2005 (JP) ..... 2005-106674

(51) Int. Cl.
*F01M 11/10* (2006.01)

(52) U.S. Cl. ..... 123/196 S; 123/196 R

(58) Field of Classification Search ..... 123/198 D, 123/196 S, 196 R; 184/6.1, 6.4
See application file for complete search history.

(56) References Cited

U.S. PATENT DOCUMENTS 4,839,831 A * 6/1989 Imajo et al. ..... 73/53.05
4,995,357 A * 2/1991 Gonnering et al. ... 123/198 DC
5,950,591 A * 9/1999 Kageyama et al. ..... 123/196 S
5,964,318 A * 10/1999 Boyle et al. ..... 184/1.5
6,810,858 B2 * 11/2004 Ito et al. ..... 123/478
6,966,304 B2 * 11/2005 Nagaishi et al. ..... 123/480
2004/0035398 A1 2/2004 Klugl et al.
2004/0099252 A1 5/2004 Nagaishi et al.
2004/0182378 A1 * 9/2004 Oshimi et al. ..... 123/685
2006/0192122 A1 * 8/2006 Chen et al. ..... 250/339.13

FOREIGN PATENT DOCUMENTS

JP 7-11981 1/1995
JP 8-177432 7/1996
JP 10-317936 12/1998
JP 2004-211638 7/2004
WO WO 2006/005650 A1 1/2006

* cited by examiner

*Primary Examiner*—Stephen K. Cronin
*Assistant Examiner*—Ka Chun Leung
(74) *Attorney, Agent, or Firm*—Oblon, Spivak, McClelland, Maier & Neustadt, P.C.

(57) ABSTRACT

An upper level sensor or the like is used to detect an amount of lubricant in an oil pan of an engine. When the amount of lubricant exceeds a prescribed value (step ST1), that is, when lubrication of a sliding portion such as a bearing is insufficient due to dilution of the lubricant with fuel, control for lowering engine output such as control for lowering a maximum combustion pressure (step ST3) is carried out, so that combustion load applied to the sliding portion such as a bearing is suppressed when the maximum combustion pressure is attained and seizure of a connecting rod bearing or the like is prevented.

4 Claims, 3 Drawing Sheets

CONTROL DEVICE OF INTERNAL COMBUSTION ENGINE

This nonprovisional application is based on Japanese Patent Application No. 2005-106674 filed with the Japan Patent Office on Apr. 1, 2005, the entire contents of which are hereby incorporated by reference.

BACKGROUND OF THE INVENTION

1. Field of the Invention

The present invention relates to a control device of an internal combustion engine, that controls an operation state of the internal combustion engine in which a lubricant circulates through each sliding portion.

2. Description of the Background Art

An exhaust gas exhausted when an internal combustion engine (hereinafter, also referred to as an engine) such as a gasoline engine or a diesel engine is driven contains substances of whose emission into the atmosphere is not preferable. In particular, the exhaust gas from the diesel engine contains particulate matter (PM) mainly composed of carbon, soot, soluble organic fraction (SOF), and the like, all of which cause air pollution.

As an apparatus for purifying the particulate matter (hereinafter, referred to as PM) contained in the exhaust gas, an exhaust purifying apparatus, in which a particulate filter is arranged in an exhaust manifold of the diesel engine so as to collect PM contained in the exhaust gas passing through the exhaust manifold, thus reducing an amount of emission into the atmosphere, has been known. For example, a diesel particulate filter (DPF) or a diesel particulate-NOx reduction system (DPNR) catalyst is used as the particulate filter.

When the particulate filter is used to collect the PM and if an amount of deposit of the collected PM increases, the particulate filter is clogged. If clogging of the filter takes place, increase in pressure loss of the exhaust passing through the particulate filter as well as corresponding increase in exhaust back pressure of the engine take place, which results in lower engine output and lower fuel efficiency.

In order to solve such a problem, conventionally, a temperature of the exhaust is raised at a time point when the amount of PM collected by (deposited on) the particulate filter reaches a certain level, so that the PM on the particulate filter is burnt and removed to recondition the particulate filter.

As a reconditioning method, for example, a small amount of fuel is auxiliarily injected (post-injection) after main fuel injection and before closing of an exhaust valve, in order to raise the temperature of the exhaust gas and to burn the PM deposited on the particulate filter (see, for example, Japanese Patent Laying-Open No. 2004-211638). It is noted that post-injection may be performed not only for filter reconditioning treatment but also for improvement in engine performance.

Here, it has been known that, as a result of post-injection, a part of injected fuel adheres to a wall surface in a cylinder, the adhered fuel dilutes the engine lubricant, and viscosity of the engine lubricant is lowered. It has also been known that, when viscosity lowers with higher temperature of the engine lubricant, lubrication of each sliding portion of the engine tends to be insufficient (see, for example, Japanese Patent Laying-Open No. 8-177432).

In the diesel engine, a maximum combustion pressure has increased as a result of technological progress in a commonrail, an injector (a fuel injection valve), and the like. In addition, recently, in order to improve fuel efficiency of the engine, an engine lubricant of low viscosity is used to reduce friction. Moreover, for further lower friction, a width of a sliding portion such as a bearing has been made smaller.

Such increase in the maximum combustion pressure, lower viscosity of the lubricant, and smaller width of the bearing are effective for improvement in engine performance and fuel efficiency. On the other hand, load imposed on the bearing (load due to combustion pressure) is increased, which means an environment disadvantageous in terms of seizure of the bearing.

If the lubricant is diluted as a result of post-injection or the like described above and viscosity of the lubricant is further lowered in an environment severe in terms of lubrication, it becomes difficult to ensure an oil film thickness of a sliding surface of each engine portion. Consequently, lubrication of the sliding surface becomes insufficient, and seizure of the sliding portion such as a bearing is likely. In particular, as considerable combustion load is applied to a connecting rod bearing, seizure of the bearing is more likely.

SUMMARY OF THE INVENTION

The present invention was made in view of the above-described situation, and an object of the present invention is to provide a control device of an internal combustion engine capable of ensuring resistance to seizure of a sliding portion such as a bearing in spite of dilution of an engine lubricant due to post-injection or the like.

The present invention is characterized in that, in a control device of an internal combustion engine, controlling an operation state of the internal combustion engine in which a lubricant circulates through each sliding portion, includes a lubricant amount detection portion detecting an amount of the lubricant, when the amount of the lubricant exceeds a prescribed value, control for lowering output of the internal combustion engine is carried out.

According to the present invention, the amount of lubricant in the internal combustion engine (hereinafter, referred to as the engine) is detected. When the amount of lubricant exceeds the prescribed value, that is, when the lubricant is diluted by the fuel and lubrication of the sliding portion such as a bearing is insufficient, control for lowering the engine output is carried out, and therefore, seizure of the sliding portion such as a bearing can be prevented. For example, in the diesel engine, control for lowering the maximum combustion pressure is carried out when the amount of lubricant exceeds the prescribed value, so that combustion load applied to the sliding portion such as the bearing can be suppressed when the maximum combustion pressure is attained and seizure of the connecting rod bearing or the like can be prevented.

Since the present invention adopts such a configuration that lowering in viscosity is detected based on the amount of lubricant, resistance to seizure can be ensured without a relatively expensive sensor such as an oil temperature sensor. Namely, the present invention is advantageous also in terms of cost.

According to the present invention, when the amount of lubricant exceeds the prescribed value, control for reducing an amount of fuel supply to the engine may be carried out. With such a configuration, from a time point when the amount of lubricant exceeds the prescribed value, that is, when it is estimated that the viscosity of the lubricant is lowered, an amount of fuel supply is reduced. Therefore, dilution of the lubricant by the fuel can be suppressed, and consequently, resistance to seizure of the sliding portion such as the bearing can be enhanced.

According to the present invention, when the amount of lubricant exceeds the prescribed value, control for lowering a temperature of a coolant of the engine may be carried out. With such a configuration, the temperature of the lubricant can be lowered and reduced in viscosity of the lubricant can be suppressed. Consequently, the oil film thickness can be ensured, and resistance to seizure of the sliding portion such as the bearing can be enhanced.

According to the present invention, the lubricant amount detection portion may be implemented by an upper level sensor that turns ON when a fluid level of the lubricant in an oil pan of the engine exceeds a prescribed upper limit level. With the use of such an upper level sensor, a function and effect as described above can be achieved with relatively low cost.

According to the present invention, the amount of lubricant circulated in the engine is detected. When the amount of lubricant exceeds the prescribed value, control for lowering the engine output is carried out, so that resistance to seizure of the sliding portion such as the bearing can be ensured in spite of dilution of the lubricant due to post-injection or the like.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention will be described hereinafter with reference to the drawings.

An engine to which the present invention is applied will initially be described.

Engine

Figure 1:
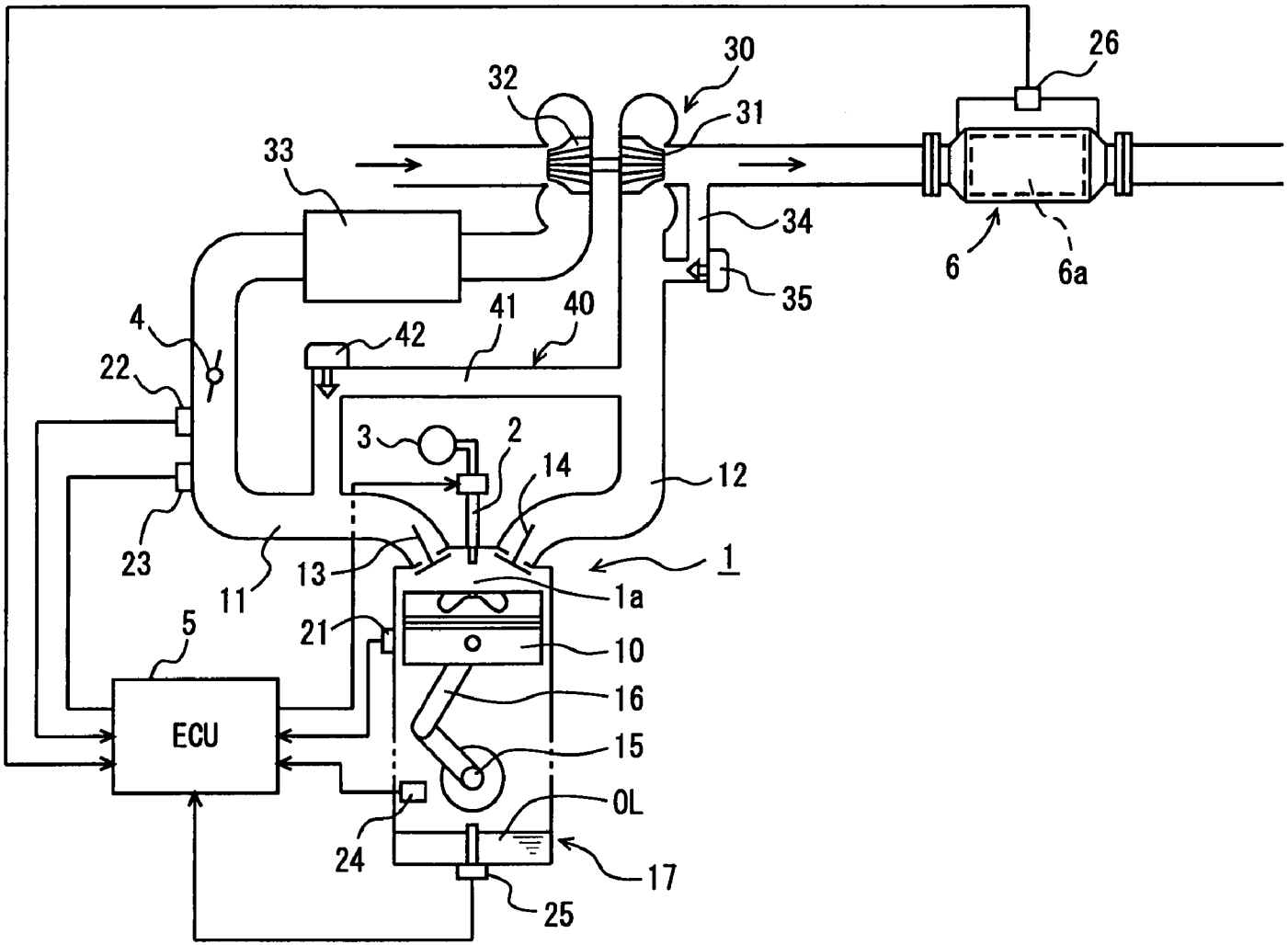
FIG. 1 is a schematic configuration diagram showing one example of an engine to which the present invention is applied.

A schematic configuration of a diesel engine (hereinafter, simply referred to as "engine") to which the present invention is applied will be described with reference to FIG. 1. It is noted that FIG. 1 shows solely a configuration of a single cylinder in the engine.

An engine 1 in this example is implemented, for example, by a four-cylinder engine, and includes a piston 10 forming a combustion chamber 1*a* and a crankshaft 15 serving as an output shaft.

Piston 10 is connected to crankshaft 15 through a connecting rod 16, so that reciprocating motion of piston 10 is converted to rotation of crankshaft 15 by connecting rod 16. An engine speed sensor 24 is provided in crankshaft 15. In addition, a coolant temperature sensor 21 for detecting an engine coolant temperature is arranged in engine 1.

An oil pan 17 storing engine lubricant OL (hereinafter, referred to as lubricant OL) is provided in a lower portion of a cylinder block of engine 1. Though not shown, lubricant OL stored in oil pan 17 is pumped up by an oil pump through an oil strainer for removal of foreign matters during operation of engine 1, and thereafter purified by an oil filter and supplied to piston 10, a camshaft (not shown), crankshaft 15, connecting rod 16, and the like for lubrication, cooling and the like of each portion. After lubricant OL supplied in such a manner is used for lubrication, cooling and the like of each portion in engine 1, lubricant OL returns to oil pan 17, and lubricant OL is stored in oil pan 17 until it is pumped up again by the oil pump.

An oil level sensor 25 is arranged in oil pan 17. Oil level sensor 25 is implemented by an upper level sensor (for example, a limit switch) that turns ON when a fluid level of lubricant OL in oil pan 17 exceeds a prescribed upper limit level. It is noted that oil level sensor 25 is provided such that it turns ON, for example, when lubricant OL is diluted by 10% (the amount of lubricant attains to 110%).

Engine 1 is provided with an injector (fuel injection valve) 2 directly injecting fuel into combustion chamber 1*a* of each cylinder. A commonrail (accumulator) 3 is connected to injector 2. The fuel is supplied from a high-pressure fuel pump (not shown) to commonrail 3 and each injector 2 is opened at prescribed timing, so that the fuel is injected into combustion chamber 1*a* of each cylinder of engine 1. The injected fuel is burnt in combustion chamber 1*a* and exhausted as exhaust gas. Valve-opening timing (fuel injection timing) of injector 2 is controlled by an ECU 5 which will be described later.

An intake manifold 11 and an exhaust manifold 12 are connected to combustion chamber 1*a* of engine 1. An intake valve 13 is provided between intake manifold 11 and combustion chamber 1*a*. By opening/closing intake valve 13, connection or disconnection between intake manifold 11 and combustion chamber 1*a* is achieved. In addition, an exhaust valve 14 is provided between exhaust manifold 12 and combustion chamber 1*a*. By opening/closing exhaust valve 12, connection or disconnection between exhaust manifold 12 and combustion chamber 1*a* is achieved. Opening/closing of intake valve 13 and exhaust valve 14 is achieved by rotation of an intake camshaft and an exhaust camshaft (none of which is shown) to which rotation of crankshaft 15 is transmitted.

An intake shutter 4, an intake air temperature sensor 22, an intake air pressure sensor 23 for determining an amount of intake air, and the like are arranged in intake manifold 11.

An exhaust purifying apparatus 6 or the like including a DPF 6*a* is arranged in exhaust manifold 12 of engine 1. Exhaust purifying apparatus 6 includes a pressure difference sensor 26 detecting a pressure difference between upstream and downstream of DPF 6*a*.

Engine 1 is provided with a turbocharger (supercharger) 30 supercharging the intake air by utilizing exhaust pressure. Turbocharger 30 is constituted of a turbine 31 arranged in exhaust manifold 12 and a compressor 32 arranged in intake manifold 11. Turbine 31 arranged in exhaust manifold 12 rotates by receiving exhaust energy, and compressor 32 arranged in intake manifold 11 accordingly rotates. Then, the intake air is supercharged as a result of rotation of compressor 32, and the supercharged air is forcibly introduced into combustion chamber 1*a* of each cylinder of engine 1. Intake manifold 11 includes an intercooler 33 for cooling the intake air at a high temperature as a result of compression by compressor 32.

Exhaust manifold 12 is provided with a bypass pipe 34 bypassing turbocharger 30. Bypass pipe 34 includes a wastegate valve 35. A position of wastegate valve 35 is controlled so as to vary an amount of exhaust that passes through bypass pipe 34, so that rotation speed of turbocharger 30 can be adjusted. As a result of control of rotation speed of turbocharger 30, a supercharge pressure of engine 1 can be regulated. As the turbocharger, a variable nozzle turbocharger, in which a variable nozzle is provided on a side of the turbine (the side of the exhaust manifold) so as to regulate the supercharge pressure by changing the position thereof, may be employed.

Engine 1 further includes an EGR apparatus 40. EGR apparatus 40 serves to lower an amount of NOx generation by introducing a part of the exhaust gas into the intake air to lower a combustion temperature in the cylinder. EGR apparatus 40 is constituted of an EGR pipe 41 communicating between intake manifold 11 and exhaust manifold 12, an EGR valve 42 provided in EGR pipe 41, and the like. By adjusting a position of EGR valve 42, an amount of EGR (an amount of exhaust gas return) introduced from exhaust manifold 12 to intake manifold 11 can be adjusted. Here, the position of EGR valve 42 and the position of wastegate valve 35 are both controlled by ECU 5.

ECU

Figure 2:
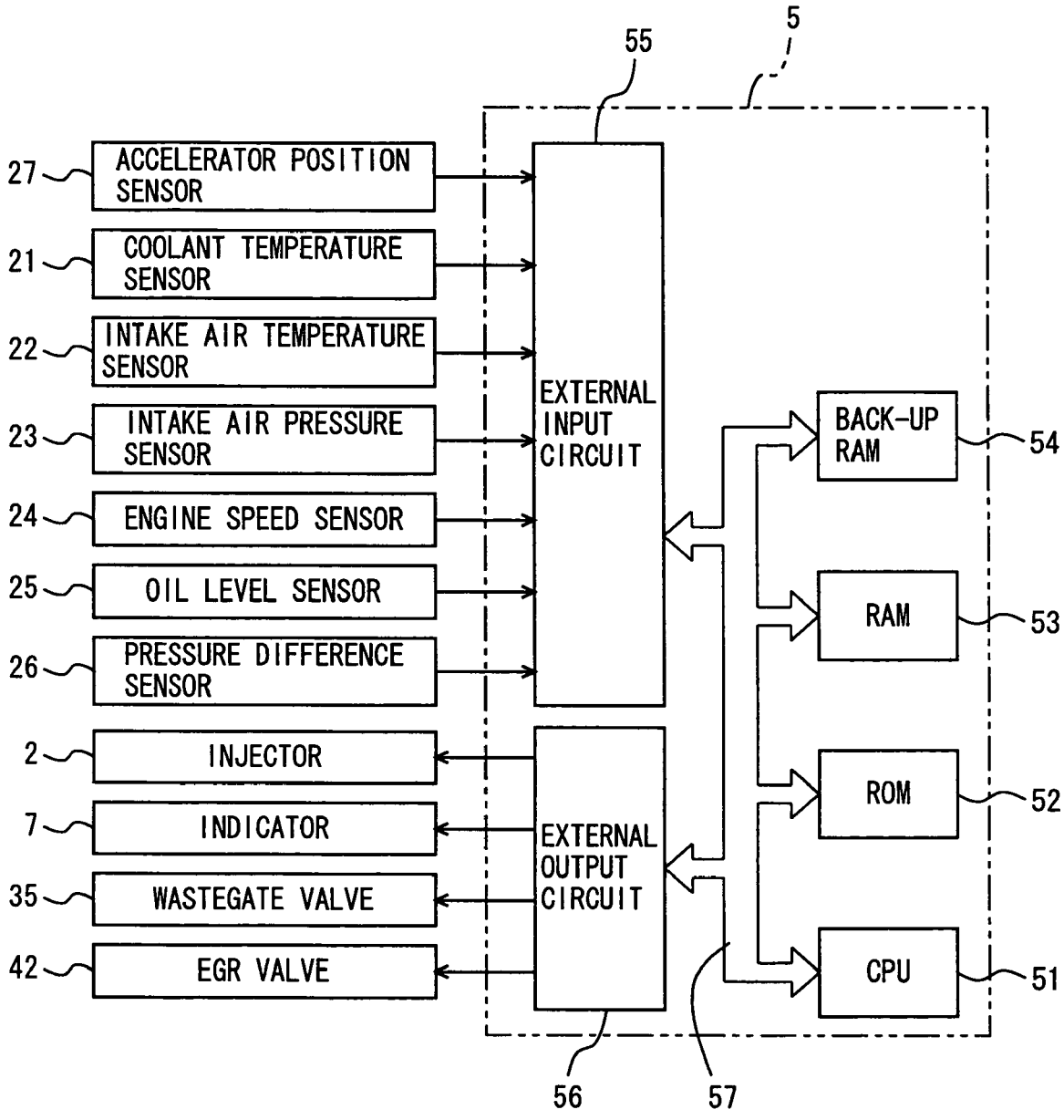
FIG. 2 is a block diagram showing a configuration of a control system such as an ECU.

As shown in FIG. 2, ECU 5 includes a CPU 51, an ROM 52, an RAM 53, a back-up RAM 54, and the like. ROM 52 stores a variety of control programs, maps that are referred to in executing the variety of control programs, and the like. CPU 51 performs various types of operational processing based on the variety of control programs and maps stored in ROM 52. RAM 53 serves as a memory that temporarily stores a result of operation performed in CPU 51, data input from each sensor, and the like. Back-up RAM 54 serves as a non-volatile memory that stores data or the like to be stored, for example, when engine 1 is stopped.

ROM 52, CPU 51, RAM 53, and back-up RAM 54 described above are connected to each other through a bus 57, and connected to an external input circuit 55 and an external output circuit 56.

An accelerator position sensor 27, coolant temperature sensor 21, intake air temperature sensor 22, intake pressure sensor 23, engine speed sensor 24, oil level sensor 25, pressure difference sensor 26, and the like are connected to external input circuit 55. Meanwhile, injector 2, an electromagnetic spill valve (not shown) of the high-pressure fuel pump, indicator 7 giving warning of abnormality in an amount of oil, wastegate valve 35, EGR valve 42, and the like are connected to external output circuit 56.

ECU 5 carries out various types of control of engine 1 such as fuel injection control, based on outputs from various sensors such as accelerator position sensor 27, coolant temperature sensor 21, intake air temperature sensor 22, intake air pressure sensor 23, engine speed sensor 24, and the like. In addition, ECU 5 controls post-injection and combustion pressure described below.

Post-Injection Control

ECU 5 estimates an amount of deposit of the PM collected on DPF 6*a* based on an output from pressure difference sensor 26 provided in exhaust purifying apparatus 6. ECU 5 determines that timing to recondition DPF 6*a* has come when the estimated amount of PM is equal to or larger than a prescribed reference value (deposit limit), and causes post-injection to occur after main fuel injection in engine 1. As a result of post-injection, the PM deposited on DPF 6*a* is burnt and removed, thus reconditioning DPF 6*a*.

Here, for post-injection control, for example, the following method is adopted. Specifically, a control map for PM reconditioning where a target post-injection amount and injection timing for raising a temperature to a target exhaust temperature at which DPF 6*a* can be reconditioned are defined is prepared and stored in advance, and injector 2 is controlled by using the control map for PM reconditioning.

In addition, as a method of estimating the amount of PM deposit, other methods may be adopted instead of the method using the output from pressure difference sensor 26 described above. Specifically, the methods includes a method of preparing a map by finding an amount of adhesion of PM in accordance with an operation state of engine 1 (such as an exhaust temperature, a fuel injection amount and an engine speed) in advance through an experiment or the like and the amount of PM adhesion found based on this map is accumulated to obtain the amount of PM deposit, a method of estimating the amount of PM deposit in accordance with a traveled distance or driving time, and the like.

Combustion Pressure Control

Figure 3:
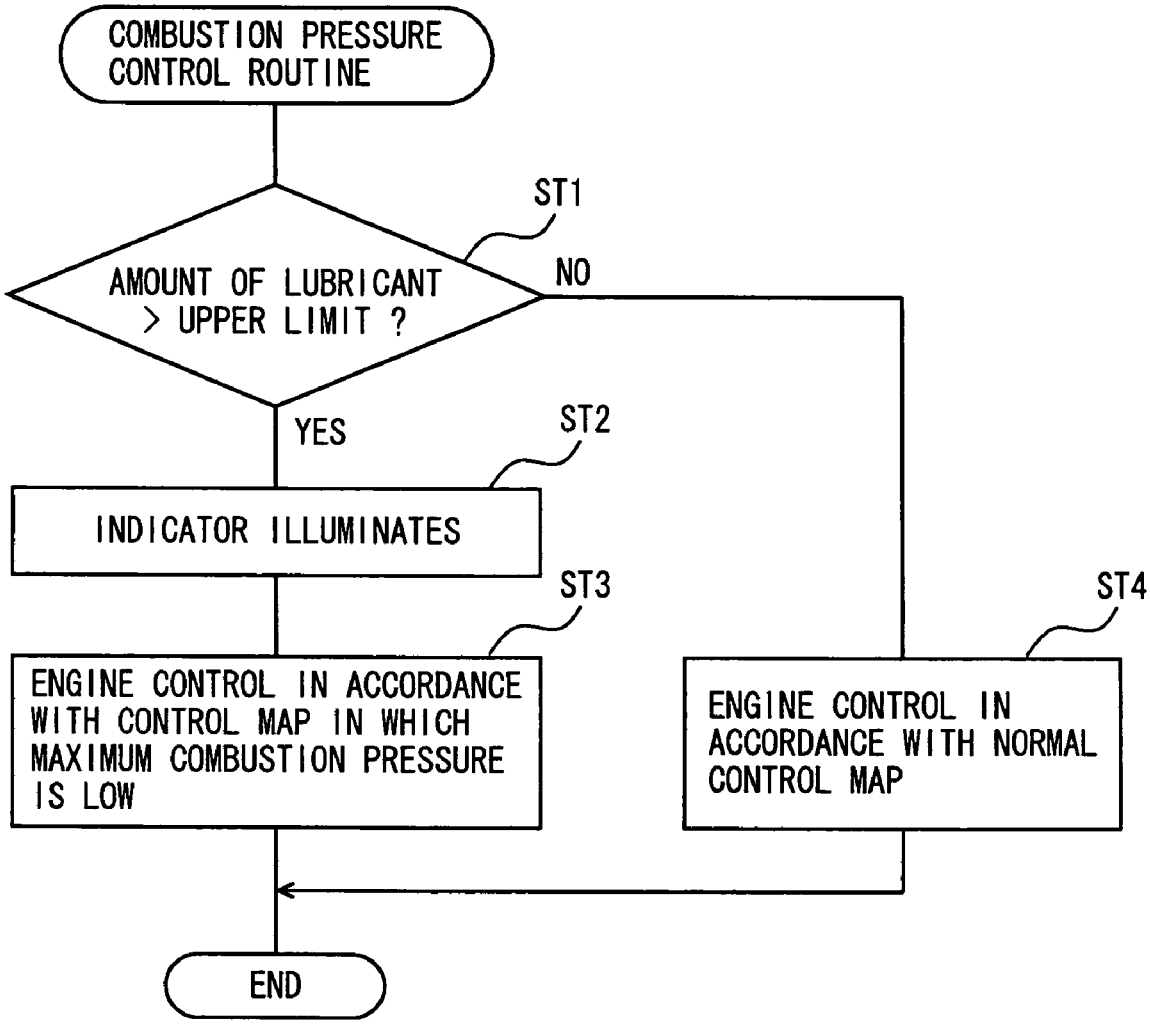
FIG. 3 is a flowchart showing processing for controlling a combustion pressure performed by the ECU.

Processing for controlling the combustion pressure performed in ECU 5 will be described with reference to the flowchart shown in FIG. 3.

Initially, ECU 5 monitors the output of oil level sensor 25, and when oil level sensor 25 turns ON, ECU 5 determines that the amount of lubricant has exceeded the upper limit (step ST1). Here, ECU 5 determines that "the amount of lubricant has exceeded the upper limit" when the ON state of oil level sensor 25 continues steadily for a prescribed time period, not as soon as oil level sensor 25 turns ON. The reason why such determination processing is performed is to avoid influence (misdetection) by transient change in the fluid level of the lubricant due to vibration or the like or by fluctuation (inclination) of the fluid level of the lubricant during cornering and driving on an inclined surface of a vehicle.

If it is determined as YES at step ST1, that is, if the amount of lubricant exceeds the upper limit, the process proceeds to step ST2, at which indicator 7 illuminates in order to give warning of abnormality in the oil amount. At step ST3, ECU 5 controls the fuel injection amount or the like of engine 1 using a control map in which the maximum combustion pressure is low. The "control map in which the maximum combustion pressure is low" used at step ST3 is, for example, such a control map that the maximum combustion pressure is lowered by 1 MPa when lubricant OL is diluted by 10% (the amount of lubricant attains to 110%) and this map is stored in ROM 52 of ECU 5 in advance.

On the other hand, if it is determined as NO at step ST1, that is, if there is no abnormality in the oil amount, the process proceeds to step ST4, at which the fuel injection amount or the like of engine 1 is controlled using a normal control map.

In the processing above, when there is no longer abnormality in the oil amount as a result of exchange of the lubricant after indicator 7 illuminates, the fluid level of lubricant OL in oil pan 17 returns to the original state (normal level). As oil level sensor 25 turns OFF in such a state, engine 1 is controlled based on the normal map.

According to the combustion pressure control described above, when the amount of lubricant OL stored in oil pan 17 exceeds the upper limit, that is, when lubricant OL is diluted by the fuel and lubrication of the sliding portion such as the bearing is insufficient, control for lowering the maximum combustion pressure is carried out. Therefore, combustion load applied to the sliding portion such as the bearing can be suppressed when the maximum combustion pressure is attained, and resistance to seizure of the sliding portion such as the bearing can be ensured. Therefore, even if lubricant OL is diluted by the fuel, seizure of the bearing or the like of connecting rod 16 can be prevented.

Other Embodiments

In addition to the configuration of the embodiment described above, such processing as control for reducing fuel supply to engine 1 when the amount of lubricant OL stored in oil pan 17 exceeds the upper limit may be performed. By adopting such a configuration, the amount of fuel supply is reduced from a time point when the amount of lubricant OL exceeds the upper limit (a state in which it is estimated that viscosity of lubricant OL has lowered). Therefore, dilution of lubricant OL by the fuel can be suppressed, and resistance to seizure of the bearing or the like can be enhanced.

Alternatively, such processing as control for lowering the temperature of the coolant of engine 1 may be performed when the amount of lubricant OL stored in oil pan 17 exceeds the upper limit. By adopting such a configuration, the temperature of lubricant OL can be lowered, and lowering in viscosity of lubricant OL can be suppressed. Consequently, an oil film thickness can be ensured, and resistance to seizure of the sliding portion such as the bearing can be enhanced.

In the embodiments described above, an oil level sensor detecting the upper limit of the fluid level of lubricant OL in oil pan 17 is employed as the sensor for detecting the amount of lubricant. The present embodiment, however, is not limited as such, and an oil level sensor detecting both of the upper limit and the lower limit of the fluid level of lubricant OL in oil pan 17 may be employed. With the use of such an oil level sensor, a single sensor can detect dilution of lubricant OL and shortage in oil.

Alternatively, a fluid level sensor capable of linearly detecting the fluid level of lubricant OL in oil pan 17 may be employed as the sensor for detecting the amount of lubricant.

Here, the engine may be controlled in such a manner that the maximum combustion pressures adapted to a plurality of types of lubricant fluid levels (such as 2.5% dilution, 5% dilution, 10% dilution, and the like) are found in advance through experiment, calculation or the like, a plurality of combustion pressure control maps based on the result thereof are prepared and stored, and every time the value detected by the (linear) fluid level sensor exceeds the lubricant fluid level corresponding to each combustion pressure control map, a combustion pressure control map in accordance with that lubricant fluid level is selected.

In such a case, if a combustion pressure control map in a region for which experiment, calculation or the like has not yet been performed is prepared through interpolation processing or the like based on the combustion pressure control map for each lubricant fluid level found in advance through experiment or the like, suppression of the maximum combustion pressure for ensuring seizure-resistance can be controlled linearly in accordance with the value detected by the fluid level sensor.

Though the present invention is applied to the diesel engine in the embodiments described above, the present invention is not limited as such. In a gasoline engine as well, the fuel adheres to the inner wall surface of the cylinder, and the lubricant is diluted by the adhered fuel, which causes seizure of the sliding portion such as the bearing. Therefore, the present invention can effectively be used for the gasoline engine.

In applying the present invention to the gasoline engine, for example, an engine speed control map in which the maximum engine speed is lower than normal is used when the amount of lubricant exceeds the upper limit, so as to control the engine and suppress the maximum engine speed, thereby ensuring resistance to seizure of the sliding portion such as the bearing.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control device of an internal combustion engine, controlling an operation state of the internal combustion engine in which a lubricant circulates through each sliding portion, comprising:

lubricant amount detection means for detecting an amount of the oil to fuel ratio of said lubricant; wherein when an amount of the dilution of the lubricant exceeds a prescribed value, said control device controlling the operational state of said internal combustion engine will lower the output of the engine.

2. The control device of an internal combustion engine according to claim 1, wherein when said amount of dilution of the lubricant exceeds the prescribed value, said control device will reduce an amount of fuel supply to said internal combustion engine.

3. The control device of an internal combustion engine according to claim 1, wherein when an amount of the dilution of the lubricant exceeds the prescribed value, said control device will reduce a temperature of a coolant of said internal combustion engine.

4. The control device of an internal combustion engine according to any one of claims 1 to 3, wherein said lubricant amount detection means is implemented by an upper level sensor that turns ON when a fluid level of the lubricant in an oil pan of the internal combustion engine exceeds a prescribed upper limit level.

* * * * *